US010239729B2

(12) United States Patent
Lustenberger

(10) Patent No.: US 10,239,729 B2
(45) Date of Patent: Mar. 26, 2019

(54) SAFETY CIRCUIT FOR AN ELEVATOR SYSTEM

(71) Applicant: Inventio AG, Hergiswil (CH)

(72) Inventor: Ivo Lustenberger, Buttisholz (CH)

(73) Assignee: INVENTIO AG, Hergiswil (CH)

( * ) Notice: Subject to any disclaimer, the term of this patent is extended or adjusted under 35 U.S.C. 154(b) by 463 days.

(21) Appl. No.: 15/038,777

(22) PCT Filed: Nov. 18, 2014

(86) PCT No.: PCT/EP2014/074941
§ 371 (c)(1),
(2) Date: May 24, 2016

(87) PCT Pub. No.: WO2015/086271
PCT Pub. Date: Jun. 18, 2015

(65) Prior Publication Data

US 2017/0001833 A1 Jan. 5, 2017

(30) Foreign Application Priority Data

Dec. 9, 2013 (EP) ..... 13196227

(51) Int. Cl.

| | |
|---|---|
| ***B66B 1/34*** | (2006.01) |
| ***B66B 5/02*** | (2006.01) |
| ***B66B 13/22*** | (2006.01) |
| ***B66B 5/00*** | (2006.01) |
| ***B66B 5/16*** | (2006.01) |
| *H01H 1/00* | (2006.01) |

(52) U.S. Cl.
CPC ..... *B66B 5/02* (2013.01); *B66B 5/0031* (2013.01); *B66B 5/16* (2013.01); *B66B 13/22* (2013.01); *H01H 2001/0005* (2013.01)

(58) Field of Classification Search
CPC ..... B66B 5/02; B66B 5/0031; B66B 5/16; B66B 13/22; H01H 2001/0005
USPC ..... 187/247, 248, 288, 289, 293, 296, 297, 187/391–393
See application file for complete search history.

(56) References Cited

U.S. PATENT DOCUMENTS

| | | | | |
|---|---|---|---|---|
| 5,107,964 | A | 4/1992 | Coste et al. | |
| 6,173,814 | B1 * | 1/2001 | Herkel | B66B 1/34 187/248 |
| 7,350,624 | B2 * | 4/2008 | Deplazes | B66B 13/22 187/316 |
| 7,575,102 | B2 * | 8/2009 | Matsuoka | B66B 5/0093 187/391 |

(Continued)

FOREIGN PATENT DOCUMENTS

| | | |
|---|---|---|
| EP | 2604566 A1 | 6/2013 |
| WO | 2011054674 A1 | 5/2011 |

*Primary Examiner* — Anthony J Salata
(74) *Attorney, Agent, or Firm* — William J. Clemens; Shumaker, Loop & Kendrick, LLP

(57) ABSTRACT

A safety circuit for an elevator system includes a first circuit having a plurality of switching contacts and a second circuit having a plurality of switching contacts. The switching contacts of the first circuit are connected in series, and the switching contacts of the second circuit are connected in parallel. Each switching contact of the first circuit is associated with a different switching contact of the second circuit. The switching contacts that are associated with each other are in opposite switching states.

14 Claims, 2 Drawing Sheets

(56) References Cited

U.S. PATENT DOCUMENTS

| | | | | |
|---|---|---|---|---|
| 8,413,765 | B2 * | 4/2013 | Stratmann | B66B 5/0031 187/247 |
| 8,430,212 | B2 * | 4/2013 | Ueda | B66B 5/0031 187/247 |
| 8,672,099 | B2 * | 3/2014 | De Coi | B66B 13/22 187/316 |
| 8,820,482 | B2 * | 9/2014 | De Coi | B66B 5/0031 187/247 |
| 8,820,484 | B2 * | 9/2014 | Rui | B66B 1/32 187/288 |
| 8,997,941 | B2 * | 4/2015 | Abad | B66B 13/22 187/247 |
| 9,061,863 | B2 * | 6/2015 | Birrer | B66B 13/22 |
| 9,309,090 | B2 * | 4/2016 | De Coi | B66B 13/22 |
| 10,011,459 | B2 * | 7/2018 | Puranen | B66B 13/22 |
| 10,073,140 | B2 * | 9/2018 | Lustenberger | B66B 5/0031 |
| 2015/0377968 | A1 * | 12/2015 | Lustenberger | B66B 5/0031 324/415 |
| 2016/0002005 | A1 * | 1/2016 | Richter | B66B 5/0031 187/289 |
| 2018/0002138 | A1 * | 1/2018 | Kattainen | B66B 5/02 |

* cited by examiner

SAFETY CIRCUIT FOR AN ELEVATOR SYSTEM

FIELD

The invention relates to a safety circuit for safely operating an elevator system, and to an elevator system comprising such a safety circuit.

BACKGROUND

Today's elevator systems are equipped with a safety circuit. This safety system is composed of a plurality of switching contacts that are connected in series and belong to different safety elements for monitoring the shaft, the door and the rope. Opening one of these switching contacts results in the interruption of the entire safety circuit. This, in turn, causes interruption of the power supply to the main drive, engaging of the brake and therefore adopting a safe idle state of the elevator system. In order to integrate all safety elements into the safety circuit, the safety circuit needs to be routed through the entire shaft and also via the traveling cable to the car. As a result of this routing, a line harness of the safety circuit routed to the safety elements and a line harness of the safety circuit routed back from the safety elements are often close together. Thus, a cross-circuit between the line harness routed to the safety elements and the one routed back cannot be excluded. However, a cross-circuit of these line harness results in that the switching contacts in the line harness therebetween have to be bridged and, consequently, their switching state can no longer be detected or is always considered as being closed. Previously, this could only be prevented by a reliable but also relatively complicated insulation.

SUMMARY

It is therefore an object of the invention to provide a safety circuit for an elevator system in which a cross-circuit is reliably detected.

The safety circuit for an elevator system preferably comprises a first circuit including a plurality of switching contacts and a second circuit including a plurality of switching contacts. The switching contacts of the first circuit are connected in series and the switching contacts of the second circuit are connected in parallel. At least one switching contact of the first circuit is associated with a switching contact of the second circuit.

Here, two switching contacts that are associated with one another are in opposite switching states. This means that when a switching contact of the first circuit is in a closed switching state, the switching state of the associated switching contact of the second circuit is open and vice versa. Accordingly, the safety circuit is only in an operating state when the switching state of all switching contacts of the first circuit is closed and the switching state of all switching contacts of the second circuit is open.

Operating state is to be understood here as the state in which a safe operation of the elevator system is ensured.

It is an advantage that a cross-circuit is reliably detected. Namely, in the case of a cross-circuit, a current flow or a voltage could be measured in the second circuit in which all switching contacts are open in the operating state. Accordingly, the elevator system could be brought into a safe idle state.

A safe state is to be understood here as the state of the elevator system when the safe-ty circuit has adopted a safe state. The safety circuit is in a safe state if at least one switch of the first circuit is open or if at least one switch of the second circuit is closed.

Preferably, a switching contact of the first circuit forcibly switches the associated switching contact of the second circuit. Thereby, safety can be additionally increased. Namely, in the case of a cross-circuit, the cross-circuit can also occur between only two cable harnesses of the first circuit and therefore would not be detectable. Due to the forced closing of the associated switching contact of the second circuit it is ensured that even in the bridged state of the safety circuit, at least the switching contact of the second circuit is detectably switched , namely closed, when the switching contact of the first circuit is opened. Thus, the elevator system can be brought into a safe idle state in this situation as well.

The safety circuit preferably has a logic circuit which monitors in each case the switching state of the first circuit and/or the switching state of the second circuit. For this purpose, the logic circuit is connected to the safety circuit and measures a current value and/or voltage value that is applied to the respective circuit.

In the case of an identical switching state of the first and the second circuits or in the case of an open switching state of the first circuit or a closed switching state of the second circuit, the logic circuit interrupts at least a voltage or current supply to the main drive and/or brake and/or control. Thus, the elevator system is shut down and is in a safe idle state.

Alternatively, a first contactor is associated with the first circuit and a second contactor is associated with the second circuit. A voltage or current supply to the main drive and/or the control and/or the brake can in each case be interrupted depending on the current state of the associated circuit by means of the first and the second contactors. During a current or voltage interruption in the first circuit, the voltage or current supply to the main drive and/or to the brake and/or to the control is interrupted. During a current or voltage increase in the second circuit, the voltage or current supply to the main drive and/or to the brake and/or to the control is interrupted.

The invention also relates to an elevator system having a safety circuit as described above.

DESCRIPTION OF THE DRAWINGS

The invention is described below in more detail by means of exemplary embodiments. In the figures.

DETAILED DESCRIPTION

Figure 1:
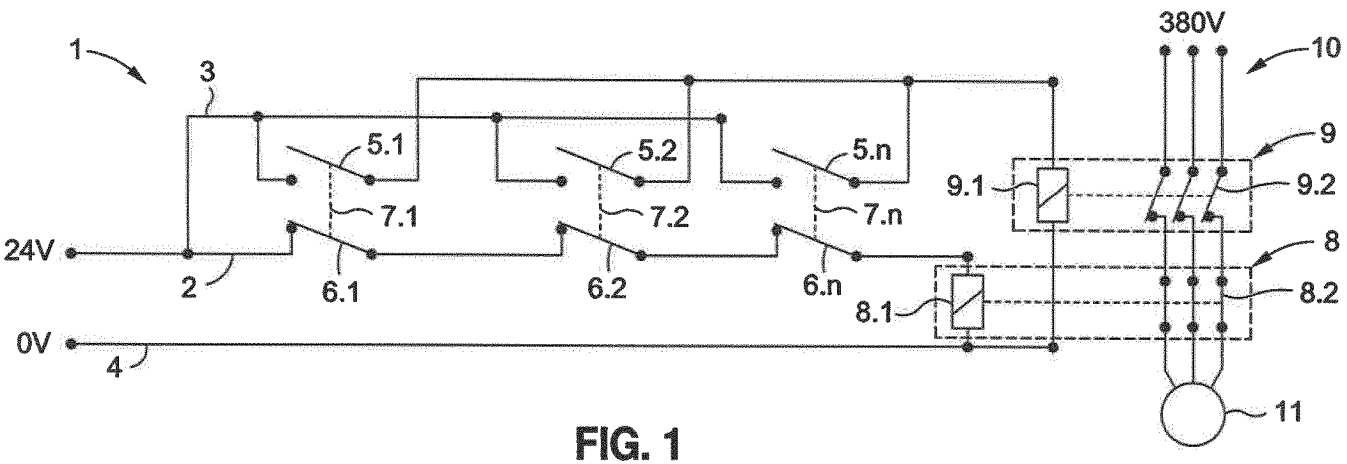
FIG. 1 schematically shows a circuit diagram of the safety circuit according to the invention of a first configuration in an operating state.

FIG. 1 shows a safety circuit 1 that is redundantly structured and has a first circuit 2 and a second circuit 3. The first circuit 2 comprises a plurality of switching contacts 6.1, 6.2, **6.*n* that are connected in series. The second circuit 3 likewise comprises a plurality of switching contacts 5.1, 5.2, 5.*n* that are connected in parallel. Each switching contact of the first circuit 2 is associated with a switching contact of the second circuit 3. Such a pair of switching contacts, e.g. 6.1, 5.1, monitors a state of a safety-relevant component of the elevator such as, for example, a shaft door, a car door, a speed limitation system, an emergency stop switch or a shaft end switch. In the example shown, each circuit 2, 3 has three switching contacts. Of course, the number of switching contacts which comprise the circuits 2, 3**, can vary depending on the number of components to be monitored.

The switching contacts 6.1, 6.2, **6.*n* of the first circuit 2 are in opposite switching states with respect to the switching contacts 5.1, 5.2, 5.*n* of the second circuit 3. The first circuit 2 is in an operating state when all switching contacts 6.1, 6.2, 6.*n* are closed. Accordingly, the second circuit 3 is in an operating state when all switching contacts 6.1, 6.2, 6.*n* are open. When a switching contact 6.1, 6.2, 6.*n* of the first circuit 2 is open or a switching contact 5.1, 5.2, 5.*n* of the second circuit 3 is closed, the first and the second circuits 2, 3** are each in a safe state.

Preferably, a switching contact 5.1, 5.2, **5.*n* of the second circuit 3 is forcibly switched via a connection 7.1, 7.2, 7*n* by a switching contact 6.1, 6.2, 6.*n* of the first circuit 2. This ensures that associated switching contacts 6.1, 5.1 can only be simultaneously in an operating state if the switching contact 6.1 of the first circuit 2 is closed and the switching contact 5.1 of the second circuit 3 is open, or in a safe state, if the switching contact 6.1 of the first circuit 2 is open and the switching contact 5.1 of the second circuit 3** is closed.

The two circuits 2, 3 are powered from a 24V voltage source. It is within the discretion of the person skilled in the art to select a voltage source which is suitable for his/her purposes, and the voltage of which can be a voltage value different than 24V, for example 12V, 36V, 110V or any other voltage value. In an operating of the first circuit 2, a corresponding current flows through the switching contacts 6.1, 6.2, **6.*n*. A first contactor 8 is connected at the end of the first circuit 2, on the one hand, to the latter and, on the other, to a 0V conductor 4. The first contactor 8 comprises a switching magnet 8.1 and a switch 8.2, wherein the latter is integrated in a three-phase power supply 10 of a main drive 11. The power supply is typically 380 V, but can also differ depending on the specific country. In accordance with a switching state of the first circuit 2, the switching magnet 8.1 switches the associated switch 8.2. The energized switching magnet 8.1 keeps the switch 8.2 closed. As soon as a switching contact 6.1, 6.2, 6.*n* of the first circuit 2 is open and the current flow in the first circuit 2 is interrupted, power supply to the switching magnet 8.1 is interrupted. As a result, the associated switch 8.2 is opened and the power supply 10 to the main derive 11 is interrupted. Thus, the switch 8.2** is a normally open contact which is open in the normal or currentless state.

In an operating state of the second circuit 3, all switching contacts 5.1, 5.2, **5.*n* thereof are open. Accordingly, the current flow in the second circuit 3 is interrupted. A second contactor 9 is connected at the end of the second circuit 3, on the one hand, to the latter and, on the other, to a 0V conductor 4. The second contactor 9 comprises a switching magnet 9.1 and a switch 9.2, wherein the latter is integrated in the power supply 10 of the main drive 11. In accordance with a switching state of the second circuit 3, the switching magnet 9.1 switches the associated switch 9.2. The switch 9.2 is closed as long as the switching magnet is de-energized. When a switching contact 5.1, 5.2, 5.*n* of the second circuit 3 is closed, the switching magnet 9.1 is supplied with current and the associated switch 9.2 is opened. Accordingly, the power supply 10 to the main drive 11 is interrupted. Thus, the switch 9.2 is a normally closed contact which is closed in the normal or currentless state. Due to the parallel connection of the switching contacts 5.1, 5.2, 5.*n*, the contactor 9 responds upon closing of each individual switching contact 5.1, 5.2, 5.*n***.

Figure 2:
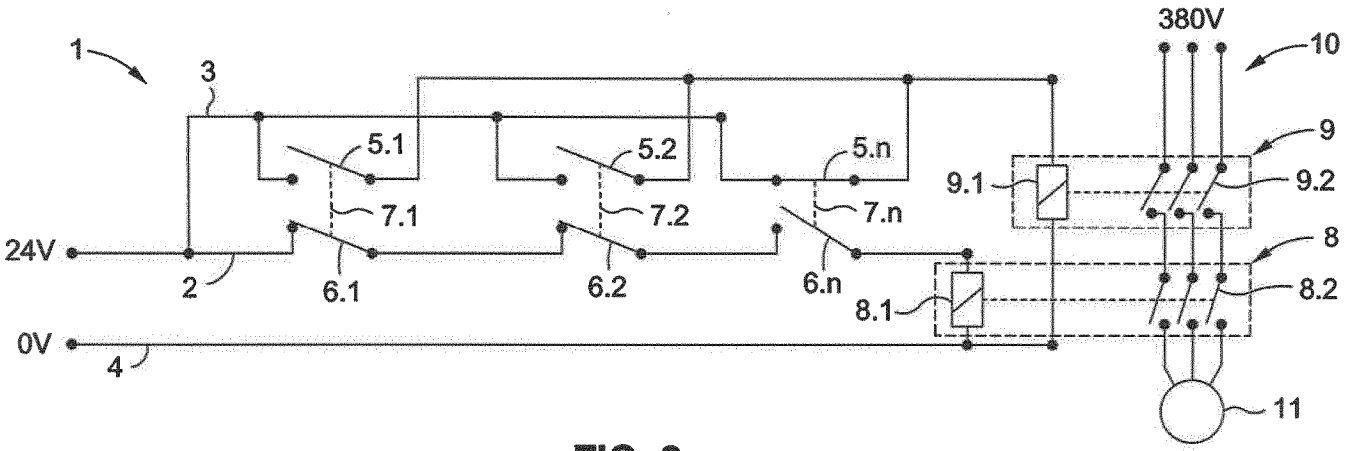
FIG. 2 schematically shows a circuit diagram of the safety circuit according to the invention of a first configuration in a safe state.

FIG. 2 shows the safety circuit 1 of FIG. 2 in a safe state. A switching contact **6.*n* of the first circuit 2 is closed. Accordingly, both the first and the second circuits 2, 3 adopt a safe state. The first contactor 8 as well as the second contactor 9 interrupt a power supply 10 of the main drive 11**. Thus, the elevator system can be transferred into a safe idle state.

Figure 3:
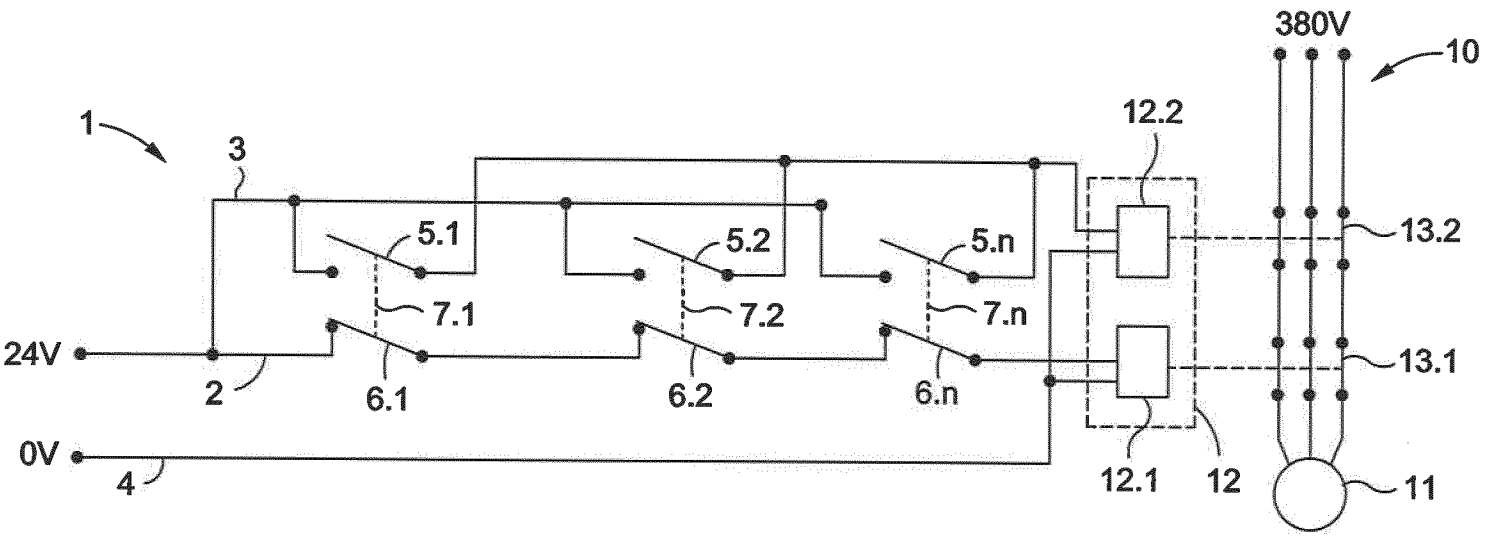
FIG. 3 schematically shows a circuit diagram of the safety circuit according to the invention of a second configuration.

In FIG. 3, an exemplary embodiment of the safety circuit 1 is shown, in which a logic circuit 12 is provided instead of contactors 8, 9 so as to switch, in accordance with a switching state of the first and/or the second circuits 2, 3, a first switch 13.1 or a second switch 13.2 in the power supply 10 of the main drive. The logic circuit 12 preferably comprises a first circuit 12.1 which is connected to the first circuit 2 and a second circuit 12.2 which is connected to the second circuit 3. Both the first and second circuits 12.1, 12.2 are connected with a 0V conductor 4.

In this exemplary embodiment, the safety circuit 1 is in an operating state. All switching contacts 6.1, 6.2, **6.*n* of the first circuit 2 are closed and all switching contacts 5.1, 5.2, 5.*n* of the second circuit 3 are open. Accordingly, current flows through the first circuit 2, and current flow through the second circuit 3 is interrupted. The logic circuits 12.1, 12.2 evaluate the incoming current values and voltage values and keep the associated switches 13.1, 13.2 closed. When a switching contact 6.1 of the first circuit 2 is opened and/or a switching contact 5.1 of the second circuit 3 is closed, the current value or the voltage value in the corresponding circuit 2, 3 changes. The first circuit 12.1 now measures a current value or voltage value of zero and opens the associated switch 13.1 in the power supply 10 of the main drive 11. The second circuit 12.1, however, now measures a current value or voltage value that differs from zero and opens the associated switch 13.2 in the power supply 10 of the main drive 11**. Thus, the elevator system can be transferred into a safe idle state.

In the example shown in FIG. 3, the two switches 13.1, 13.2 are designed as normally open contacts. Optionally, it is also possible that only one of the two switches 13.1, 13.2 is designed as a normally open contact and the other switch 13.1, 13.2 is designed as a normally closed contact.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A safety circuit for switching between a safe operation state of an elevator system and a safe idle state of the elevator system comprising:

a first circuit having a plurality of switching contacts; and a second circuit having a plurality of switching contacts, wherein the switching contacts of the first circuit are connected in series and the switching contacts of the second circuit are connected in parallel, at least one switching contact of the first circuit being associated with a switching contact of the second circuit, switching states of the associated switching contacts being in opposite switching states, and the first circuit and the second circuit being responsive to safety elements of the elevator system for controlling the switching between the safe operation state and the safe idle state of the elevator system.

2. The safety circuit according to claim 1 wherein the at least one switching contact of the first circuit forcibly switches the associated switching contact of the second circuit.

3. The safety circuit according to claim 1 wherein during an open switching state of the at least one switching contact of the first circuit, the associated switching contact of the second circuit is in a closed switching state.

4. The safety circuit according to claim 1 wherein during a closed switching state of the at least one switching contact of the first circuit, the associated switching contact of the second circuit is in an open switching state.

5. The safety circuit according to claim 1 wherein the safety circuit is only in an operating state thereby switching the elevator system into the safe operation state if the switching state of each of the switching contacts of the first circuit is closed and the switching state of each of the switching contacts of the second circuit is open.

6. The safety circuit according to claim 1 wherein the safety circuit includes a logic circuit monitoring at least one of the switching states of the switching contacts of the first circuit and the switching states of the switching contacts of the second circuit.

7. The safety circuit according to claim 6 wherein in response to identical switching states of at least one of the switching contacts of each of the first circuit and the second circuit, or in response to an open switching state of at least one of the switching contacts of the first circuit, or in response to a closed switching state of at least one of the switching contacts of the second circuit, the logic circuit interrupts a power supply to at least one of a main drive, a control and a brake of the elevator system.

8. The safety circuit according to claim 1 including a first contactor associated with the first circuit and a second contactor associated with the second circuit, each of the first contactor and the second contactor interrupting a power supply to at least one of a main drive, a control and a brake of the elevator system in response to a voltage or current in the associated one of the first circuit and the second circuit.

9. The safety circuit according to claim 8 wherein in response to a current or voltage interruption in the first circuit, the first contactor interrupts the power supply, and in response to a current or voltage increase in the second circuit, the second contactor interrupts the power supply.

10. An elevator system having safety elements and a safety circuit responsive to the safety elements for switching between a safe operation state of the elevator system and a safe idle state of the elevator system, the safety circuit comprising:

a first circuit having a plurality of switching contacts; and a second circuit having a plurality of switching contacts, wherein the switching contacts of the first circuit are connected in series and the switching contacts of the second circuit are connected in parallel, at least one switching contact of the first circuit being associated with a switching contact of the second circuit, switching states of the associated switching contacts being in opposite switching states, and the first circuit and the second circuit being responsive to the safety elements of the elevator system for controlling the switching between the safe operation state and the safe idle state of the elevator system.

11. The safety circuit according to claim 10 wherein the safety circuit includes a logic circuit monitoring at least one of the switching states of the switching contacts of the first circuit and the switching states of the switching contacts of the second circuit.

12. The safety circuit according to claim 11 wherein in response to identical switching states of at least one of the switching contacts of each of the first circuit and the second circuit, or in response to an open switching state of at least one of the switching contacts of the first circuit, or in response to a closed switching state of at least one of the switching contacts of the second circuit, the logic circuit interrupts a power supply to at least one of a main drive, a control and a brake of the elevator system.

13. The safety circuit according to claim 10 including a first contactor associated with the first circuit and a second contactor associated with the second circuit, each of the first contactor and the second contactor interrupting a power supply to at least one of a main drive, a control and a brake of the elevator system in response to a voltage or current in the associated one of the first circuit and the second circuit.

14. The safety circuit according to claim 13 wherein in response to a current or voltage interruption in the first circuit, the first contactor interrupts the power supply, and in response to a current or voltage increase in the second circuit, the second contactor interrupts the power supply.

* * * * *